US009856065B1

(12) United States Patent
Asaad et al.

(10) Patent No.: US 9,856,065 B1
(45) Date of Patent: Jan. 2, 2018

(54) DUAL CONDIMENT SIMULTANEOUS DISPENSER

(71) Applicants: Samy Asaad, Bayonne, NJ (US); Shadi Saweris, Bayonne, NJ (US)

(72) Inventors: Samy Asaad, Bayonne, NJ (US); Shadi Saweris, Bayonne, NJ (US)

( * ) Notice: Subject to any disclaimer, the term of this patent is extended or adjusted under 35 U.S.C. 154(b) by 0 days.

(21) Appl. No.: 15/222,439

(22) Filed: Jul. 28, 2016

(51) Int. Cl.

| | |
|---|---|
| ***B65D 77/08*** | (2006.01) |
| ***B65D 81/32*** | (2006.01) |
| ***B65D 23/04*** | (2006.01) |
| ***B65D 83/00*** | (2006.01) |
| ***B65D 1/04*** | (2006.01) |
| ***B65D 85/72*** | (2006.01) |
| ***B65D 43/16*** | (2006.01) |
| *B05C 17/005* | (2006.01) |

(52) U.S. Cl.
CPC ..... *B65D 81/325* (2013.01); *B65D 1/04* (2013.01); *B65D 23/04* (2013.01); *B65D 43/16* (2013.01); *B65D 83/0011* (2013.01); *B65D 85/72* (2013.01); *B05C 17/00553* (2013.01)

(58) Field of Classification Search
CPC ..... B05B 11/0078; B05B 11/3081; B05C 17/00553; B65D 1/04; B65D 23/04; B65D 43/16; B65D 81/325; B65D 83/0011; B65D 83/68; B65D 85/72
See application file for complete search history.

(56) References Cited

U.S. PATENT DOCUMENTS

| | | | | | |
|---|---|---|---|---|---|
| 2,080,134 | A | | 5/1937 | Jezler | |
| 2,845,707 | A | | 8/1958 | Redmond | |
| 2,926,818 | A | * | 3/1960 | Spero | B65D 81/325 222/135 |
| 3,027,052 | A | * | 3/1962 | Marraffino | A45D 40/0075 222/135 |
| 3,197,071 | A | | 7/1965 | Kuster | |
| 3,347,420 | A | | 10/1967 | Donoghue | |
| 3,952,920 | A | * | 4/1976 | Bergman | B27G 11/00 222/137 |
| 4,046,288 | A | * | 9/1977 | Bergman | B65D 81/325 222/135 |
| 4,334,787 | A | * | 6/1982 | Kluth | B01F 15/047 222/319 |
| 4,392,589 | A | * | 7/1983 | Herold | B05C 17/00593 222/137 |
| 4,432,469 | A | * | 2/1984 | Eble | B01F 5/0077 222/134 |
| 5,186,559 | A | | 2/1993 | Fu | |
| 5,217,145 | A | * | 6/1993 | Haan | B65D 77/08 222/129 |
| 5,332,112 | A | | 7/1994 | Blocker | |
| 5,860,572 | A | | 1/1999 | Harrold et al. | |
| 5,865,345 | A | | 2/1999 | Cistone et al. | |

(Continued)

*Primary Examiner* — Frederick C Nicolas
*Assistant Examiner* — Bob Zadeh
(74) *Attorney, Agent, or Firm* — Michael J. Feigin, Esq.; Feigin & Fridman

(57) ABSTRACT

A bottle split into two parts internally, is disclosed. Each side of the bottle has a different viscous fluid. Turning a rotatable switch on the exterior turns a corkscrew within the bottle, causing a plunger to move transverse to the direction of rotation due to its threaded engagement with the corkscrew. This, in turn, causes the two viscous fluids to exit out of an exit portal side by side simultaneously.

19 Claims, 8 Drawing Sheets

(56) References Cited

U.S. PATENT DOCUMENTS

| | | | | |
|---|---|---|---|---|
| 6,520,381 | B1 * | 2/2003 | Prestele | B05C 17/00553 222/137 |
| 7,258,251 | B2 | 8/2007 | Johnson | |
| 7,665,631 | B2 | 2/2010 | Pikowski | |

* cited by examiner

DUAL CONDIMENT SIMULTANEOUS DISPENSER

FIELD OF THE DISCLOSED TECHNOLOGY

The disclosed technology relates generally to bottles and, more specifically, to a bottle with multiple compartments which dispenses from each equally through a common exit port.

BACKGROUND OF THE DISCLOSED TECHNOLOGY

Sometimes a person wants not one, but two different things. Most dispensers only dispense one by one. Suppose you want jelly and peanut butter at the same time. First, you put on the jelly, then you put on the peanut butter. That works, but it would be more convenient if you were able to dispense both together from a single dispenser. The problem with this is that mixing the two different items together is often undesired. Many products need to be kept separate to retain their taste or consistency.

Some have tried to solve this conundrum, including Redmond, as disclosed in U.S. Pat. No. 2,867,707. This patent shows a plunger used to dispense products from a bottle. Fu, in U.S. Pat. No. 5,186,669, has two different sides, and a person squeezes in order to dispense from two chambers. Cistone, in U.S. Pat. No. 5,867,345, finally introduces two separate chambers.

What is needed in the art is a way to efficiently dispense two (or more) items from a bottle with one easy action, This must be in a way which is easy to manufacture and evenly causes flow from more than one chamber through an opening.

SUMMARY OF THE DISCLOSED TECHNOLOGY

A bottle of the embodiments of the disclosed technology has an interior bisected by a stationary plate (also referred to as a "divider") dividing a majority of the interior of the bottle into two sides. A rotatable flange or switch on an exterior side of the bottle can be rotated, causing a corkscrew to which it is fixedly attached to also rotate. The corkscrew and/or/comprising an elongated cylindrical member extends from the rotatable flange or switch into the bottle, at least partially bisecting the stationary plate. Another plate, a movable plate (or plunger) is movable and rotatable with respect to the corkscrew. That is, when rotating the rotatable flange and corkscrew, the movable plate moves in a direction transverse to the direction of rotation ("up" or "down,") where "up" or "down" are defined as the side of the bottle with an entry/exit portal into the inside on a narrow side of the bottle—the elongated side of the bottle being the side along the y-axis defining the up and down side).

Thus, the interior of the bottle is divided in part, the majority thereof, or the entirety thereof, into two sides. On one side, a first distinct viscous fluid is held, and on a second side, a second distinct viscous fluid is held. A "distinct" fluid is one which is known in the art to have a substantially different composition, and in some cases, name, in the food industry, than another fluid. A substantially different viscosity is also within the scope of a "distinct" viscous fluid.

A single portal opening into both the first and second sides of the bottle can be used. Upon moving the movable plate towards the single portal, the first distinct viscous fluid and the second distinct viscous fluid, previously separated from each other by the stationary plate, come into contact and exit out the portal side by side (defined as "without substantially being mixed as they exit the opening"), in embodiments of the disclosed technology. The stationary plate can have a portion of unitary construction which is bisected by the corkscrew. The stationary plate, in some embodiments, is fixedly attached to a side of the bottle adjacent to the rotatable flange and/or attached along its most elongated side to interior walls of the bottle.

Another way of describing a bottle of embodiments of the disclosed technology is one which has a widest portion divided into two substantially equal sides, with a tapered portion between the widest portion and a portal. The tapered portion decreases in size between the widest portion and the portal (not necessarily constantly becoming smaller, but overall from the widest portion which has a substantially constant width to the portal, the tapered region becomes substantially smaller in circumference). A corkscrew extends through a divider of the two substantially equal sides of the widest portion, a rotatable switch is operative to spin the corkscrew, and a movable plate threadedly engages with the corkscrew.

A viscous fluid is held on either of the two substantially equal sides of the widest portion, in embodiments of the disclosed technology. A first viscous fluid on one side can have a viscosity of 10% or greater dyne-second per square centimeter than a second viscous fluid on a second side of the two substantially equal sides. Viscosity levels in embodiments are anywhere between 1.2 and about 300,000 Poise.

The portal opens into an area with the first and the second viscous fluids in contact with each other (the tapered region) in some embodiments. The first and second viscous fluids can exit out of the portal side by side when the movable plate is moved towards the portal. The movable plate can have a portal through which a divider dividing the two sides passes. The portal can be a rectangle with a circular region bulging out at the center (x and/or y center) of the rectangle.

"Substantially" and "substantially shown," for purposes of this specification, are defined as "at least 90%," or as otherwise indicated. "Identical" or "exactly," for purposes of this specification, is defined as "within an acceptable tolerance level known in the art." Any device may "comprise," or "consist of," the devices mentioned there-in, as limited by the claims. Any element described may be one of "exactly" or "substantially," as described.

It should be understood that the use of "and/or" is defined inclusively, such that the term "a and/or b" should be read to include the sets: "a and b," "a or b," "a," or "b."

DETAILED DESCRIPTION OF EMBODIMENTS OF THE DISCLOSED TECHNOLOGY

A bottle split into two parts internally, is disclosed. Each side of the bottle has a different viscous fluid. Turning a rotatable switch on the exterior turns a corkscrew within the bottle, causing a plunger to move transverse to the direction of rotation, due to its threaded engagement with the corkscrew. This, in turn, causes the two viscous fluids to exit out of an exit portal side by side at the same time.

Embodiments of the disclosed technology will become clearer in view of the forthcoming description of the figures.

Figure 2:
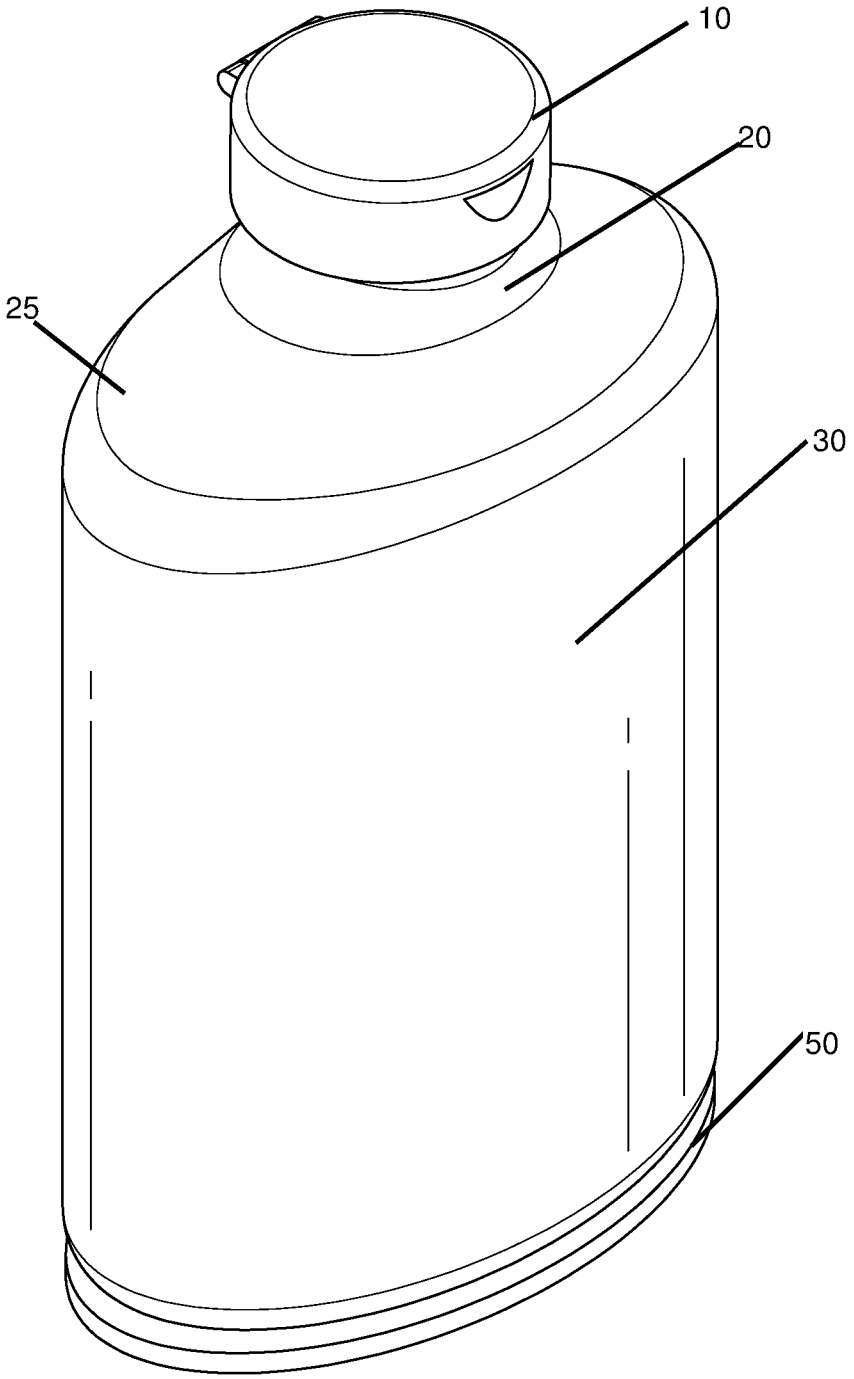
FIG. 2 shows an exterior perspective view of a dual-chamber bottle of an embodiment of the disclosed technology.

Skipping to FIG. 2, FIG. 2 shows an exterior perspective view of a dual-chamber bottle of an embodiment of the disclosed technology. The bottle has a widest section 30, a tapered section 25, and a portal region 20 with cap 10. A rotatable switch or flange 50 rotates around the devices transverse to the elongated axis of the bottle, in embodiments of the disclosed technology. For purposes of this disclosure, the elongated axis (extending in a direction from the base where the rotatable flange 50 is near or at the cap 10) is referred to as the y-axis. The x-axis is the axis about which the rotatable flange 50 rotates.

Figure 1:
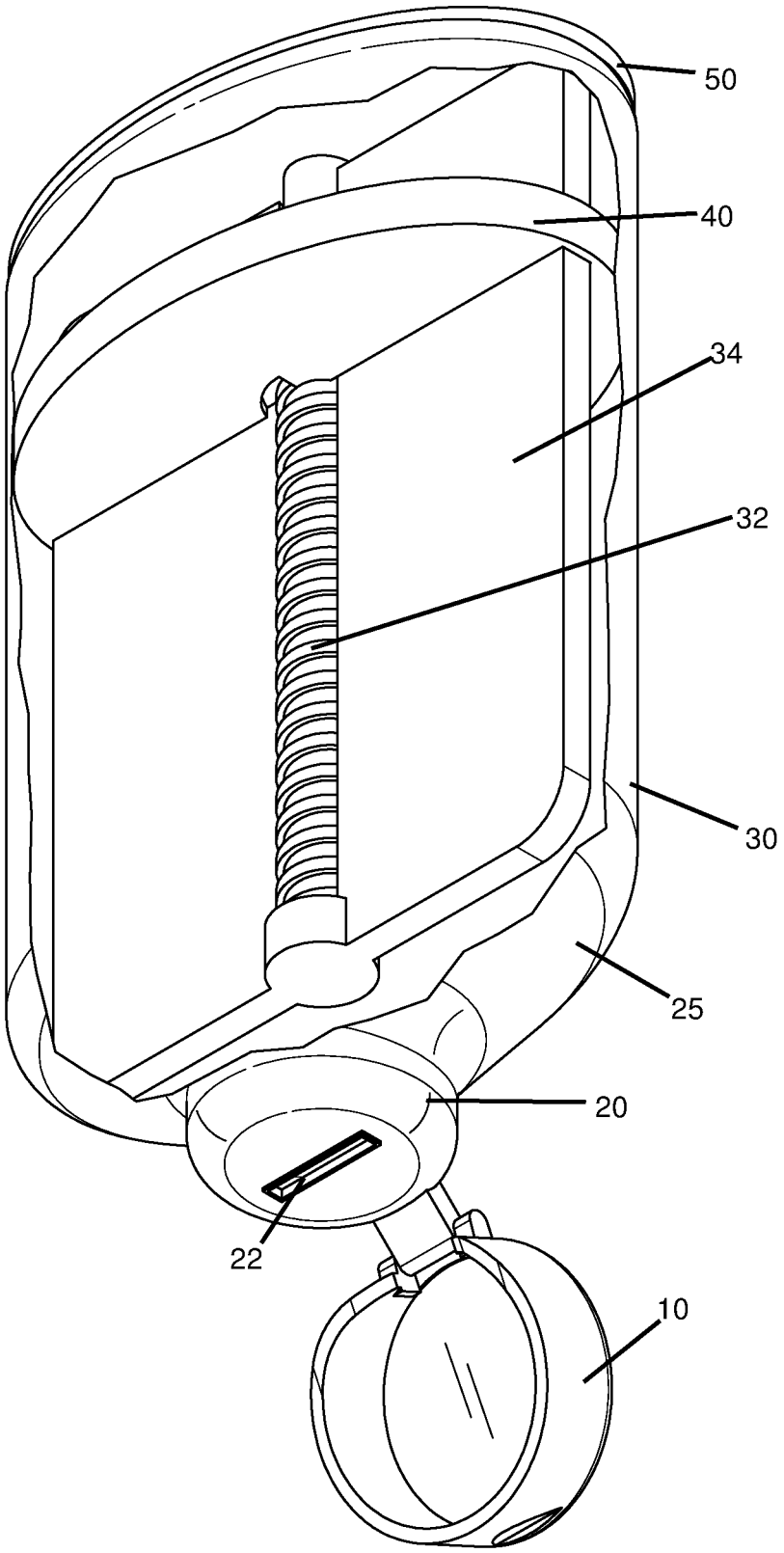
FIG. 1 shows a cross-sectional perspective view of a dual-chamber bottle of an embodiment of the disclosed technology.

FIG. 1 shows a cross-sectional perspective view of a dual-chamber bottle of an embodiment of the disclosed technology. Here, in the interior of the bottle, one can see a movable plate or plunger 40 which is threadedly engaged with a threaded corkscrew 32. Each of these parts can be procured out of plastic, metal, or another resilient and solid material. Upon rotating the flange 50, the corkscrew 32, which is fixed to the rotatable member 50, rotates around the x-axis in place, or substantially in place. That is, the corkscrew 32 is in a fixed position, or substantially fixed position, on the y-axis of the bottle (at least the exterior housing 30 of the bottle). Meanwhile, a fixed position plate 34, which is fixedly attached to the exterior housing of the bottle and/or fixed in position with respect to the bottle's exterior, divides at least a part of the interior of the bottle in half or into two sides. In embodiments, the fixed position plate 34 creates a seal between the two sides except where the corkscrew 34 passes through. The fixed position plate 34 has a longest elongated axis in the y-axis direction, in embodiments of the disclosed technology. Further, as seen in FIG. 1, in embodiments, it bisects and separates the entirety of the widest portion of the bottle. In some embodiments, it can also bisect a part of the tapered portion 25 of the bottle. It can be parallel to the opening 22 in the cap or transverse thereto.

Figure 3:
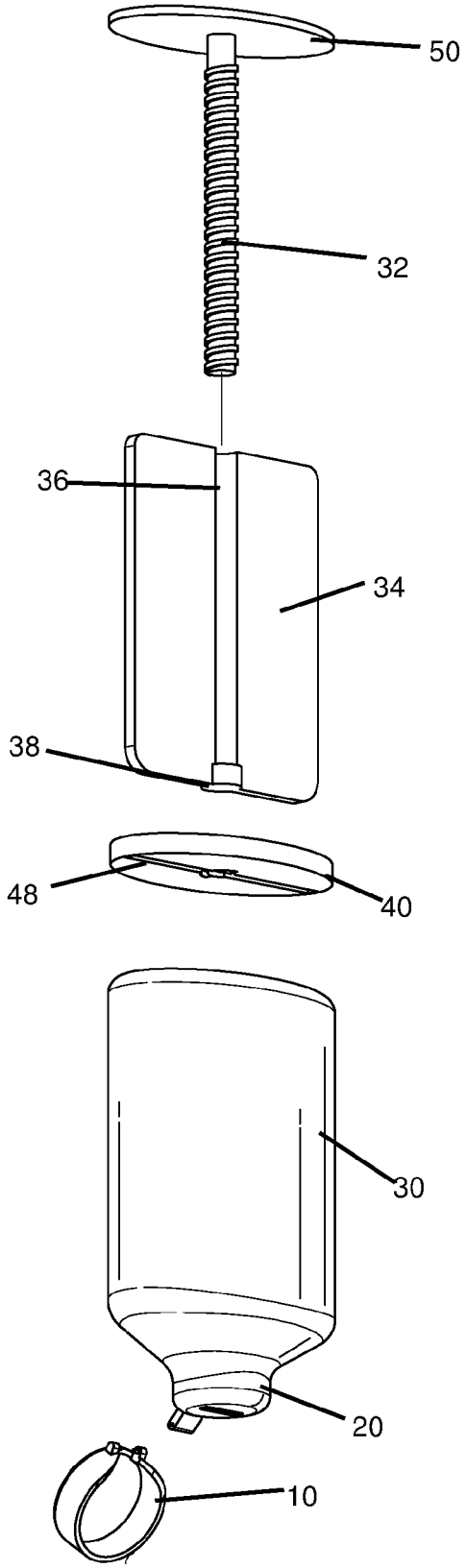
FIG. 3 shows a blown-apart view of a dual-chamber bottle of an embodiment of the disclosed technology.

FIG. 3 shows a blown-apart view of a dual-chamber bottle of an embodiment of the disclosed technology. Here, the rotatable flange 50 is shown fixed to the corkscrew 32, forming a unitary piece. For purposes of this disclosure, "fixed" and "unitary" are defined as "unable to come apart during expected use thereof, without causing irreversible destruction." This is in contact to parts that are removable from one another, which are defined as "being able to connect, or abut and disconnect, or be pulled away from each other repeatedly without causing destruction to the parts." The fixed plate 34 has a concave bend 36, in embodiments of the disclosed technology, to accommodate the corkscrew 32. In other embodiments, the fixed plate 34 is broken into two entirely separate sections which are disconnected from one another, allowing the corkscrew to fill in, or substantially fill in, the gap between the two sides of the plate 34.

The plunger or movable plate 40 has a portal 48 which is sized to fit the elongated plane of the plate 34 and corkscrew 32. The portal 48, in the embodiment shown in FIG. 3, is rectangular, with a circle cutout in the center, such that there is a circular bulge in the middle of the rectangular portal. In this manner, the plunger, or movable plate 40, can slide up and down the elongated axis of the plate. It does so due to its threaded engagement with the corkscrew 32. When the rotatable switch 50 is turned, the corkscrew 32 turns but remains in place on the y-axis of the device, causing the threaded movable plate 40 to move up or down (along the y-axis).

Figure 4:
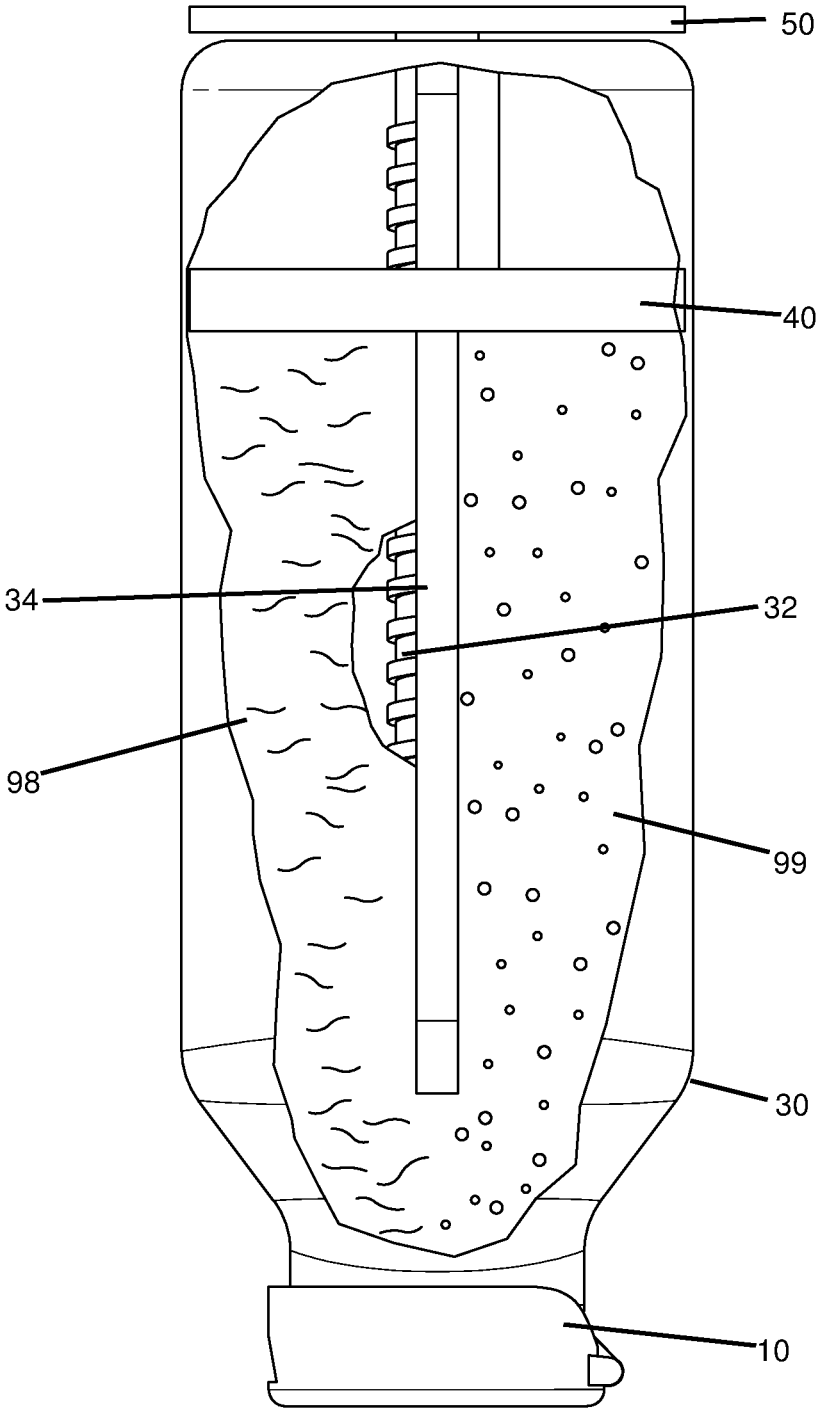
FIG. 4 shows a cross-sectional elevation view of a dual-chamber bottle of an embodiment of the disclosed technology.

FIG. 4 shows a cross-sectional elevation view of a dual-chamber bottle of an embodiment of the disclosed technology. Here, in addition to the plunger 40 being shown and the side of the stationary plate 34, one can see the corkscrew 32 extending wider than the plate 34. Note that the stationary plate 34 bisects the entirety of the widest region 30 of the bottle and a minority of the tapered region 25 in this embodiment. Note also that there are two viscous fluids, 98 and 99. One viscous fluid is on a first side of the plate and the other on a second side of the plate. They remain unmixed with each other on either side of the plate, and then are side by side with each other, or substantially side by side (minimal mixing) in the tapered region, and exit substantially side by side from the cap 10 and portal 22, in embodiments of the disclosed technology.

The amount of mixing of the viscous fluids depends on the size of the mixing region (where the plate does not separate the two sides), if such a mixing region exists at all), and the viscosity of the viscous fluids 98 and 99. Some fluids which can be used include oils (e.g., olive oil—84 cP at 20 degrees Celsius), pancake syrup (2500 cP), maple syrup (3200 cP), peanut butter (250,000 cP), and jelly (300,000 cP). The cP measurement refers to Poise, a measure of viscosity. The viscosity levels given are by way of example only, and any fluids/mixtures with a viscosity between about 20 cP and 500,000 cP are contemplated as being within the scope of the disclosed technology. Other viscous fluids which can be used include chocolate syrup or chocolate containing products, marshmallow or marshmallow containing products, and the like. Non-food products can also be used, such as, for example, glue.

Figure 5:
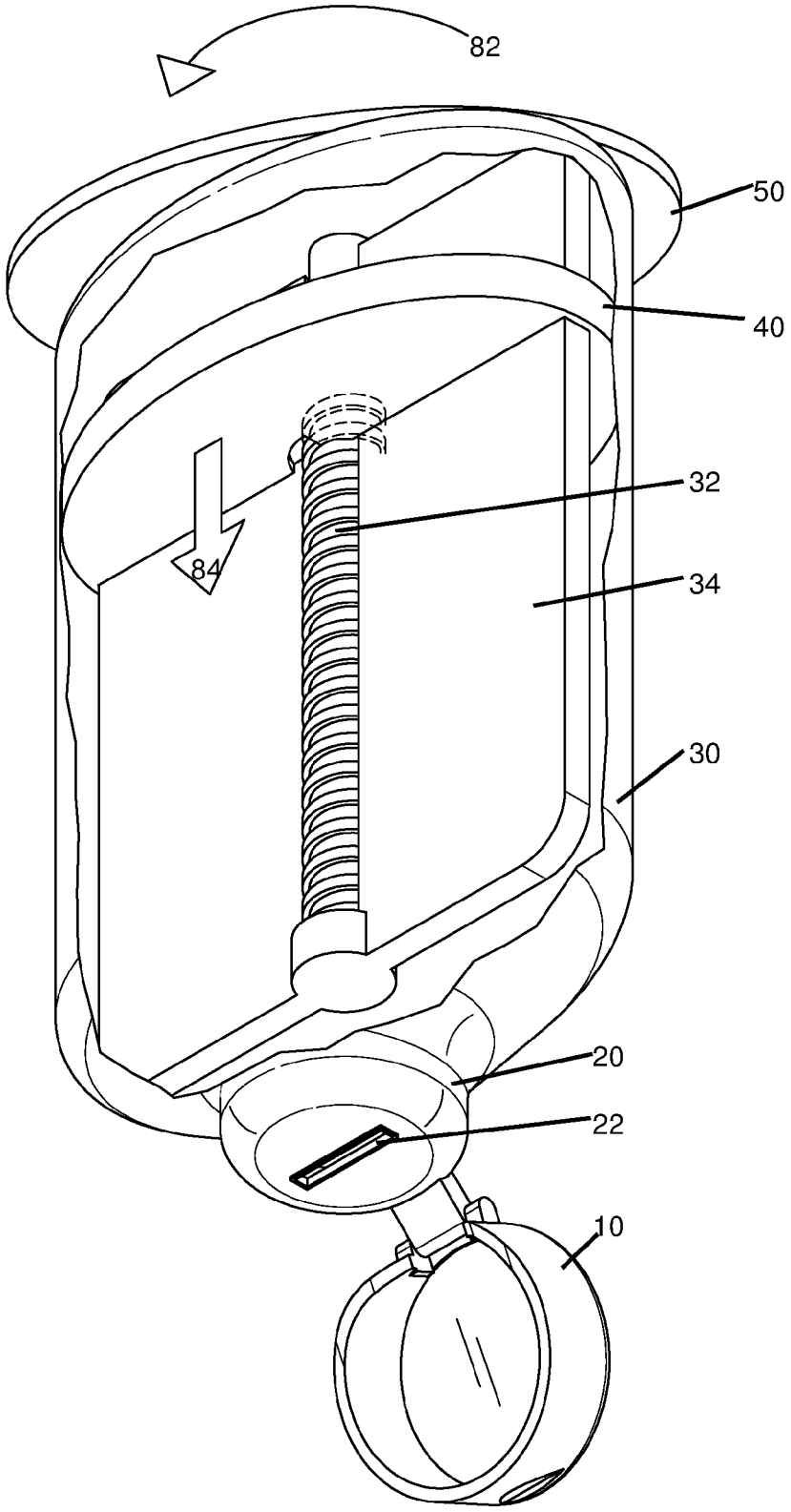
FIG. 5 shows a cross-sectional perspective view, with a plunger pushing downwards, of a dual-chamber bottle of an embodiment of the disclosed technology.

FIG. 5 shows a cross-sectional perspective view, with a plunger pushing downward, of a dual-chamber bottle of an embodiment of the disclosed technology. Here, the rotation of the rotatable plate 50 is shown rotating in the direction 82, transverse to the y-axis of the device. Meanwhile, the movable plate 40 moves downward in the direction 84 along the stationary plate 34, pushing the contents of the bottle out of the portal 22 in the narrowest region 20 of the bottle. Note the corkscrew shown (in dotted lines) on the movable plate 40 which engage with the corkscrew 32 via the threads. Such threaded engagement causes the plate 40 to move based on the rotation of the corkscrew.

Figure 6:
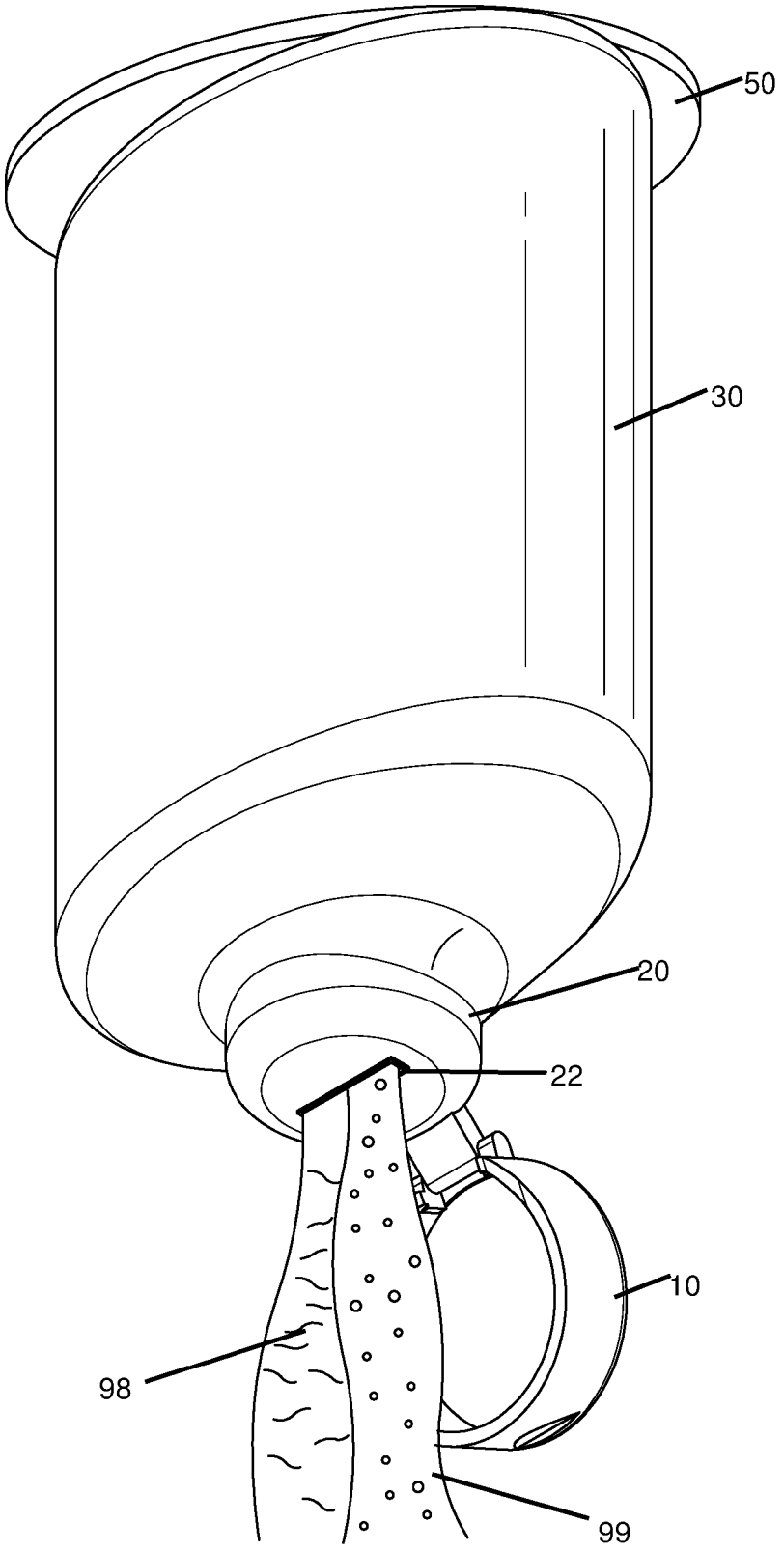
FIG. 6 shows an exterior perspective view, with a plunger pushing downward, of a dual-chamber bottle of an embodiment of the disclosed technology.

FIG. 6 shows an exterior perspective view, with a plunger pushing downward, of a dual-chamber bottle, of an embodiment of the disclosed technology. Here, while the rotatable switch 50 is being rotated, the plate 40 is moving downward and the viscous liquids 98 and 99 are exiting substantially side by side but jointly (at the same time) through the opening 22.

Figure 7:
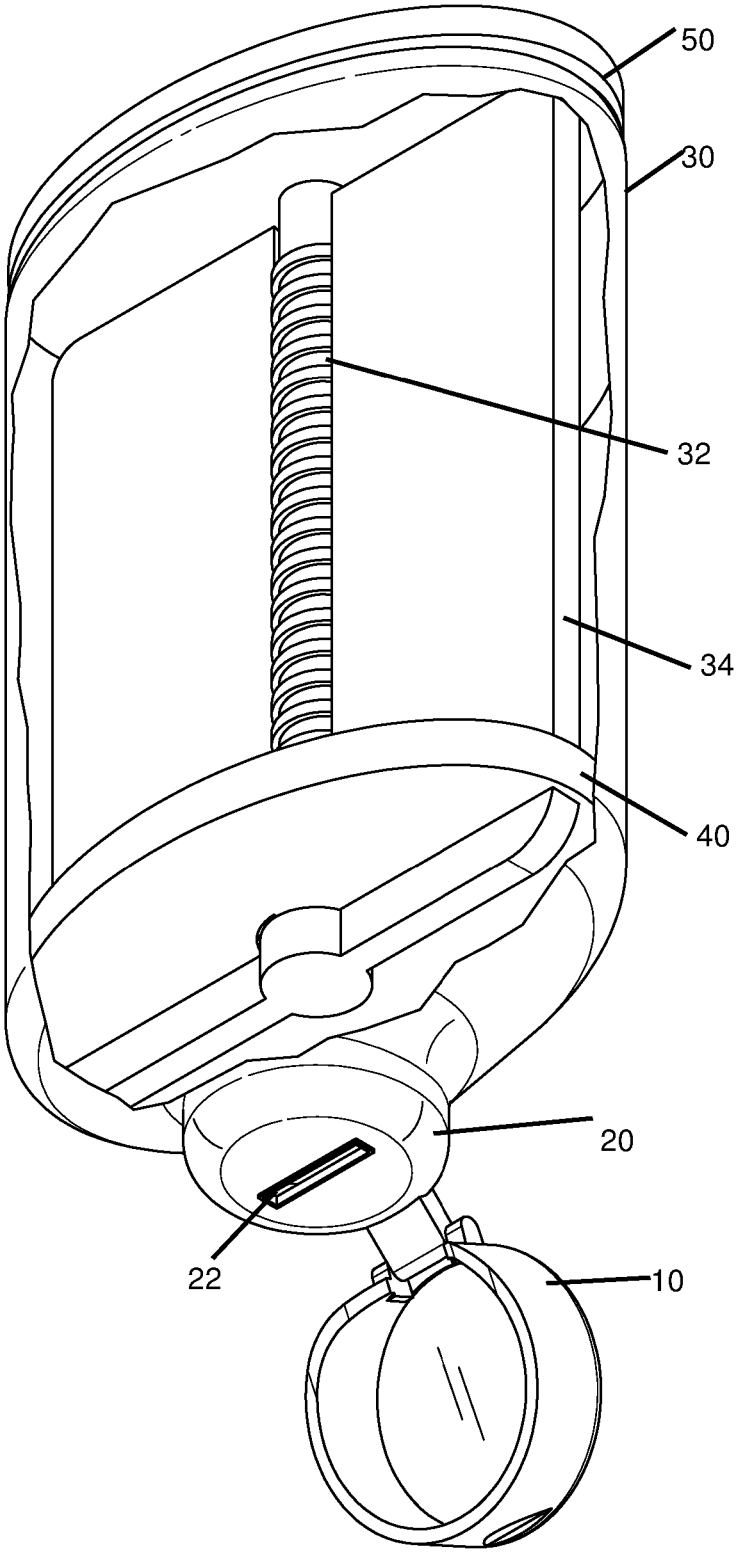
FIG. 7 shows a cross-sectional perspective view, with a plunger pushed all the way down, of a dual-chamber bottle of an embodiment of the disclosed technology.
Figure 8:
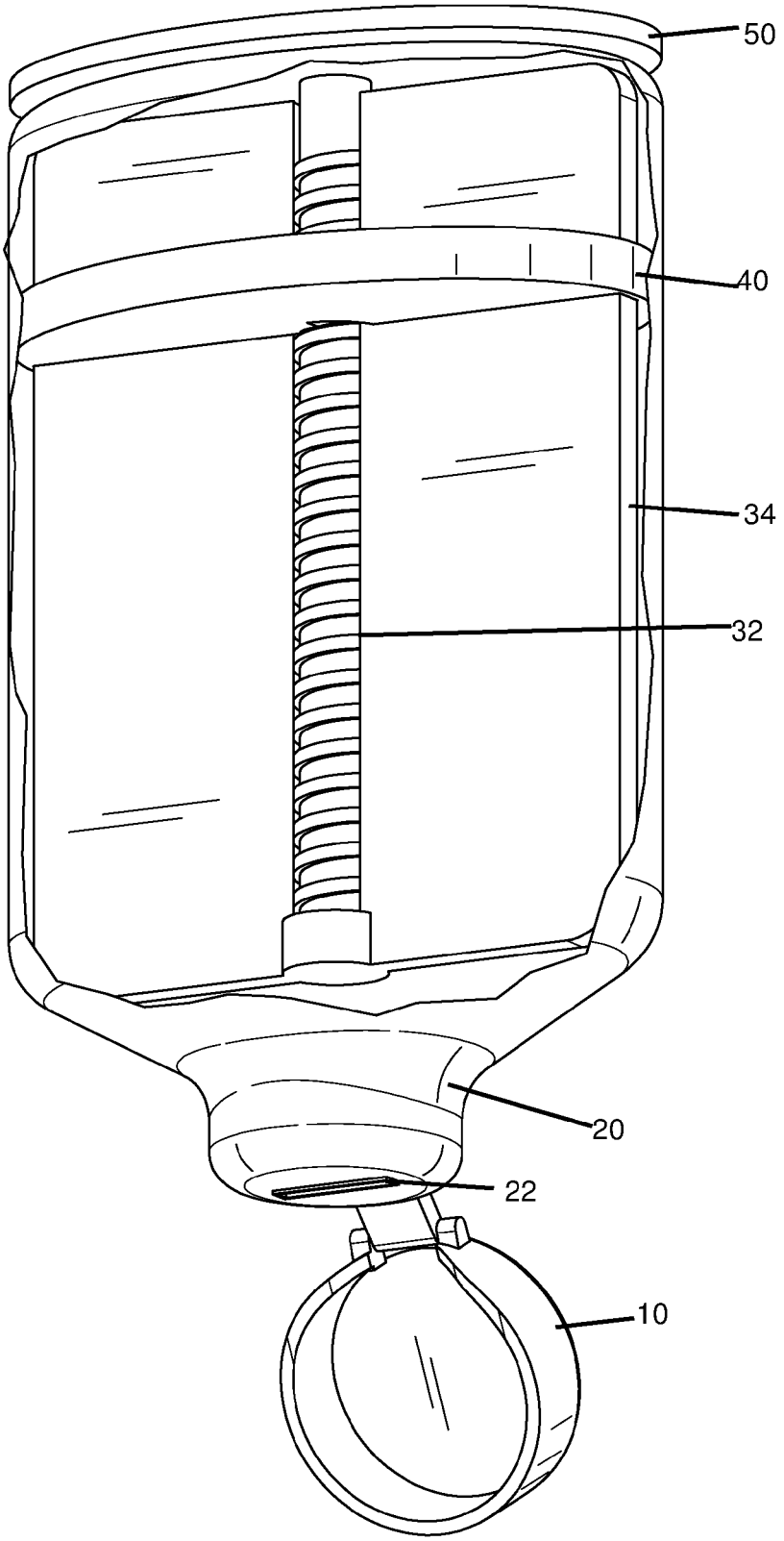
FIG. 8 shows a cross-sectional elevation view, of a dual-chamber bottle of an embodiment of the disclosed technology.

FIG. 7 shows a cross-sectional perspective view, with a plunger pushed all the way down, of a dual-chamber bottle, of an embodiment of the disclosed technology. FIG. 8 shows a cross-sectional elevation view of a dual-chamber bottle, of an embodiment of the disclosed technology. These additional views provide aid in seeing the different aspects of the device.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

We claim:

1. A bottle comprising:

an interior bisected by a stationary plate dividing a majority of said interior of said bottle into two sides;

a rotatable flange on an exterior side of said bottle;

a corkscrew fixedly connected to said rotatable flange extending into said bottle and bisecting said stationary plate;

a movable plate movably and rotatably attached to said corkscrew;

wherein rotation of said rotatable flange rotates said corkscrew, and said movable plate moves in a direction transverse to said rotation.

2. The bottle of claim 1, wherein a first side of said two sides comprises a first distinct viscous fluid, and a second side of said two sides comprises a second distinct viscous fluid.

3. The bottle of claim 2, further comprising a single portal opening into both said first and said second side of said bottle.

4. The bottle of claim 3, wherein, upon moving said movable plate toward said single portal, said first distinct viscous fluid and said second distinct viscous fluid, previously separated from each other by said stationary plate, come in contact and exit out said portal side by side.

5. The bottle of claim 4, wherein said stationary plate comprises a portion of unitary construction which is bisected by said corkscrew.

6. The bottle of claim 5, wherein said stationary plate is fixedly attached to a side of said bottle adjacent to said rotatable flange.

7. The bottle of claim 6, wherein said stationary plate is further fixedly attached along its most elongated side to interior walls of said bottle.

8. The bottle of claim 1, wherein said stationary plate is situated inside of a portal of said movable plate.

9. The bottle of claim 8, wherein said corkscrew is further situated inside said portal of movable plate.

10. The bottle of claim 9, wherein said portal of said movable plate is a combination of a rectangle shape with a circle at a mid-point of said rectangular shape.

11. A bottle, comprising:

a widest portion divided into two substantially equal sides;

a tapered portion between said widest portion and a portal decreasing in size between said widest portion and said portal undivided between said two substantially equal sides;

a corkscrew extending through a divider of said two substantially equal sides of said widest portion;

a rotatable switch operative to spin said corkscrew;

a movable plate threadedly engaged with said corkscrew.

12. The bottle of claim 11, wherein viscous fluid is held on either of said two substantially equal sides of said widest portion.

13. The bottle of claim 12, wherein a first viscous fluid on one side of said two substantially equal sides has a viscosity of 10% or greater dyne-second per square centimeter than a second viscous fluid on a second side of said two substantially equal sides.

14. The bottle of claim 13, wherein said portal opens into an area with said first and said second viscous fluids in contact with each other.

15. The bottle of claim 14, wherein said first and second viscous fluids exit out of said portal side by side when said movable plate is moved towards said portal.

16. The bottle of claim 13, wherein said first viscous fluid is jelly and said second viscous fluid is peanut butter.

17. The bottle of claim 13, wherein said first viscous fluid comprises chocolate and said second viscous fluid comprises marshmallow.

18. The bottle of claim 11, wherein said movable plate comprises a portal through which a divider dividing said two sides passes.

19. The bottle of claim 11, wherein said portal of said movable plate is formed from a circle at a center of a rectangle.

* * * * *